US011552427B2

(12) United States Patent
Yoshida et al.

(10) Patent No.: US 11,552,427 B2
(45) Date of Patent: Jan. 10, 2023

(54) CONNECTOR HOUSING AND WIRE HARNESS

(71) Applicant: Yazaki Corporation, Tokyo (JP)

(72) Inventors: Masaoki Yoshida, Kakegawa (JP); Yuichi Motoshige, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 22 days.

(21) Appl. No.: 17/469,433

(22) Filed: Sep. 8, 2021

(65) Prior Publication Data

US 2022/0077627 A1 Mar. 10, 2022

(30) Foreign Application Priority Data

Sep. 9, 2020 (JP) ..... JP2020-151097

(51) Int. Cl.
*H01R 13/52* (2006.01)
*H01R 13/422* (2006.01)

(52) U.S. Cl.
CPC ..... *H01R 13/5219* (2013.01); *H01R 13/4223* (2013.01)

(58) Field of Classification Search
CPC ..... H01R 13/5219; H01R 13/4223; H01R 13/213; H01R 13/111; H01R 13/113; H01R 13/114; H01R 13/5025
USPC ..... 439/271, 842, 843
See application file for complete search history.

(56) References Cited

U.S. PATENT DOCUMENTS 4,527,851 A * 7/1985 Gallusser ..... H01R 13/5219 439/744
5,503,569 A * 4/1996 Huss, Jr. ..... H01R 13/4365 439/595
5,667,413 A * 9/1997 Trafton ..... H01R 13/187 439/271
5,916,002 A * 6/1999 Gottschalk ..... H01R 13/53 439/839
6,171,146 B1 * 1/2001 Fink ..... H01R 13/4223 439/752
6,210,191 B1 * 4/2001 Sai ..... H01R 13/5221 439/198
6,443,764 B2 * 9/2002 Makita ..... H01R 13/5219 439/271

(Continued)

FOREIGN PATENT DOCUMENTS

JP 2019-200906 A 11/2019

*Primary Examiner* — Marcus E Harcum
(74) *Attorney, Agent, or Firm* — Sughrue Mion, PLLC

(57) ABSTRACT

A connector housing includes a housing body, a sealing member interposed between an outer circumferential surface of the housing body and an inner circumferential surface of a mating housing body to seal a space between the outer circumferential surface and the inner circumferential surface, a restriction wall portion standing on the outer circumferential surface of the housing body and positioned on a side of the rear opening with respect to a position of the sealing member, and a restriction flexible piece formed on a circumferential wall of the housing body and formed in a cantilever beam shape, the restriction flexible piece being configured such that a projection of a free end thereof is pushed up by a connector terminal so the free end protrudes from the outer circumferential surface, and the free end restricts movement of the sealing member toward the side of the connection side opening.

6 Claims, 5 Drawing Sheets

(56) References Cited

U.S. PATENT DOCUMENTS

| | | | | |
|---|---|---|---|---|
| 6,786,768 | B2 * | 9/2004 | Murakami | H01R 13/4365 439/271 |
| 7,988,502 | B2 * | 8/2011 | Nagano | H01R 13/4362 439/752 |
| 9,478,898 | B2 * | 10/2016 | Iihoshi | H01R 13/5219 |
| 9,941,636 | B2 * | 4/2018 | Jodon De Villeroche | H01R 13/639 |
| 10,946,939 | B1 * | 3/2021 | Montague | H01R 13/521 |
| 2001/0046814 | A1 * | 11/2001 | Tsuji | H01R 13/641 439/625 |
| 2002/0009923 | A1 * | 1/2002 | Kashiyama | H01R 13/641 439/595 |
| 2002/0076995 | A1 * | 6/2002 | Kurimoto | H01R 13/5208 439/752 |
| 2002/0187676 | A1 * | 12/2002 | Kurimoto | H01R 13/4362 439/595 |
| 2007/0059967 | A1 * | 3/2007 | Itou | H01R 13/5219 439/345 |
| 2010/0267264 | A1 * | 10/2010 | Sawai | H01R 13/5219 439/271 |
| 2011/0045701 | A1 * | 2/2011 | Tsuruta | H01R 13/65912 439/607.53 |
| 2011/0171855 | A1 * | 7/2011 | Fujiwara | H01R 9/0518 439/607.41 |
| 2017/0310040 | A1 * | 10/2017 | Gagnon | H01R 13/428 |
| 2019/0356082 | A1 | 11/2019 | Kurita | |

* cited by examiner

CONNECTOR HOUSING AND WIRE HARNESS

TECHNICAL FIELD

The present invention relates to a connector housing for accommodating a connector terminal of an electric wire with terminal, and a wire harness having the connector housing.

BACKGROUND

Conventionally, many of wire harnesses to be wired in places where liquid such as water could get on, such as wire harnesses arranged underfloor of a motor vehicle, are provided with a structure for preventing ingress of the liquid into an interior of a connector housing provided at an end of the wire harness. One place that could be a liquid ingress path is a path passing through a connection side opening positioned on a side for connection with a mating connector housing. As one example of a structure for preventing the ingress of the liquid, a structure in which the above-mentioned path is sealed with a sealing member made of resin is known.

There is also proposed a structure for sealing with a sealing member a rear side where a connector terminal is accommodated and where an electric wire portion of an electric wire with terminal extends outside, the rear side being another example of the liquid ingress path although it is not the path passing through the connection side opening positioned on the side for connection with a mating connector housing (refer for example to Patent Document 1). In this structure, the sealing member fitted from a rear opening of a connector housing is retained by a component mounted from further rear side so that it does not fall off from the connector housing. By applying this structure to the path passing through the connection side opening positioned on the side for connection with the mating connector housing, it is possible to prevent the ingress of the liquid through this path.

PRIOR ART DOCUMENT

Patent Document 1: JP 2019-200906 A

SUMMARY OF THE INVENTION

Problem to be Solved by the Invention

However, in the structure as described above provided with the component for retaining the sealing member, the number of components is increased, and also the structure becomes complicated as a mounting structure for the retaining component is required at the connector housing.

In view of the above-described problems, an object of the present invention is to provide a connector housing that is configured to seal with a sealing member a path passing through a connection side opening positioned on a side for connection with a mating connector housing and that is capable of reducing the number of components and capable of preventing complication in a structure. It is also an object of the present invention to provide a wire harness including said connector housing.

Solution to the Problem

In order to achieve the above-described object, the present invention provides, in a first aspect, a connector housing including: a housing body formed in a tube shape having a connection side opening formed on one end side of the housing body and a rear opening positioned on a side opposite to the connection side opening, the connection side opening of the housing body being configured to enter inside a tube-shaped mating housing body of a mating wire harness, the mating wire harness including the mating housing body accommodating therein a mating connector terminal of a mating electric wire with terminal, the housing body is capable of accommodating a connector terminal of an electric wire with terminal from the rear opening such that the connector terminal is connected to the mating connector terminal at the connection side opening; a sealing member made of resin and formed in a ring shape, the sealing member being configured to pass the housing body therethrough, the sealing member being configured such that, when the connection side opening of the housing body enters inside the mating housing body, the sealing member is interposed between an outer circumferential surface of the housing body and an inner circumferential surface of the mating housing body to seal a space between the outer circumferential surface and the inner circumferential surface; a restriction wall portion standing on the outer circumferential surface of the housing body and positioned on a side of the rear opening with respect to a position of the sealing member, the restriction wall portion being provided over an entire circumference in a circumferential direction of the housing body, the restriction wall portion being configured to restrict movement of the sealing member to the side of the rear opening; and a restriction flexible piece formed on a circumferential wall of the housing body and positioned on a side of the connection side opening with respect to the position of the sealing member, the restriction flexible piece being surrounded by a U-shaped slit formed by cutting the circumferential wall such that the restriction flexible piece is formed in a cantilever beam shape having one end that is a fixed end and another end that is a free end, the free end including a projection protruding toward an inner side of the circumferential wall, the restriction flexible piece being configured such that, when the connector terminal is accommodated from the rear opening, the restriction flexible piece is bent such that the projection is pushed up by the connector terminal so the free end protrudes from the outer circumferential surface, and the free end thereby restricts movement of the sealing member toward the side of the connection side opening.

Further, in order to achieve the above-described object, the present invention provides a wire harness including an electric wire with terminal and the connector housing described above that is configured to accommodate a connector terminal of the electric wire with terminal.

Advantageous Effect of the Invention

According to the connector housing described above, the sealing member that is interposed between the outer circumferential surface of the housing body and the inner circumferential surface of the mating housing body seals a path through which liquid ingresses inside the housing body via the connection side opening positioned on the side for connection with the mating connector housing. In addition to this, this sealing member is sandwiched between the restriction wall portion standing at a side of the rear opening with respect to the position of the sealing member and the free end of the restriction flexible piece protruding at the side of the connection side opening when the connector terminal is accommodated, thereby retaining the sealing member so as not to fall off from the housing body. The restriction wall portion and the restriction flexible piece can both be integrally formed with the housing body, thus the number of components associated with the installation of the sealing member can be reduced and complication in the structure can be prevented.

Further, according to the above-described wire harness, the wire harness is provided with the above-described connector housing. Thus, the number of components can be reduced and complication in the structure can be prevented, while sealing with the sealing member the path that passes through the connection side opening positioned on the side for connection with the mating connector housing.

DETAILED DESCRIPTION OF THE EXEMPLARY EMBODIMENTS

One embodiment of a connector housing and of a wire harness will be described below.

Figure 1:
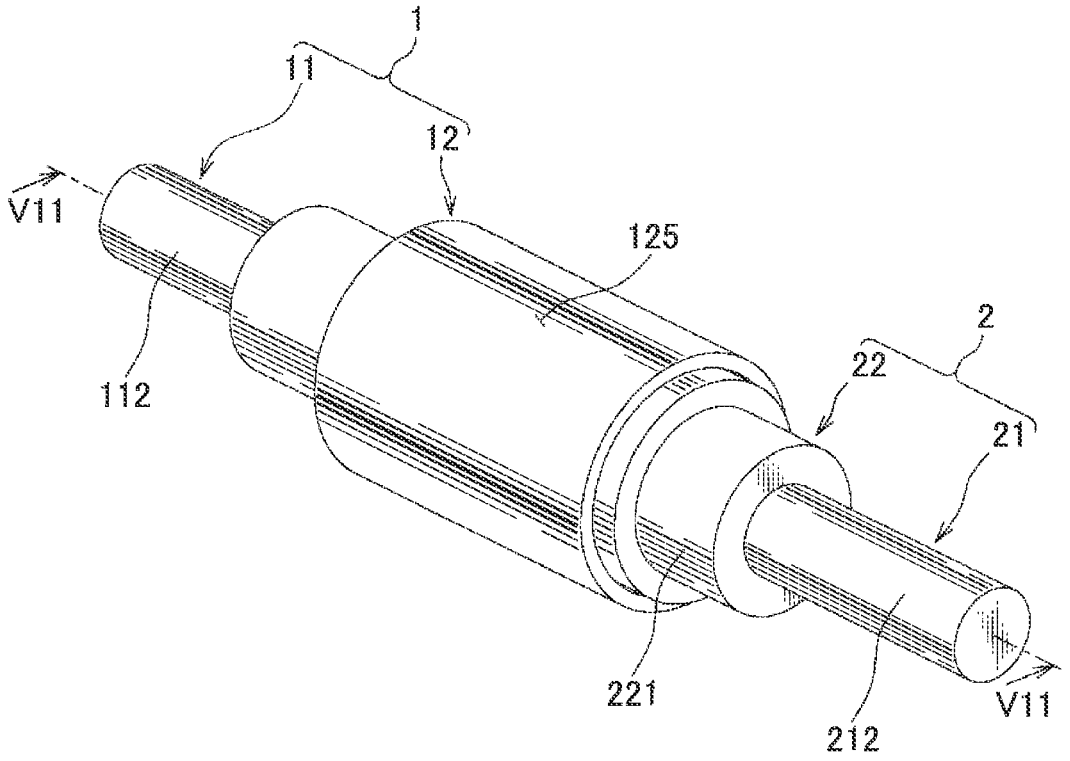
FIG. 1 is a perspective view of a wire harness having a connector housing according to one embodiment to which a mating wire harness is connected.
Figure 2:
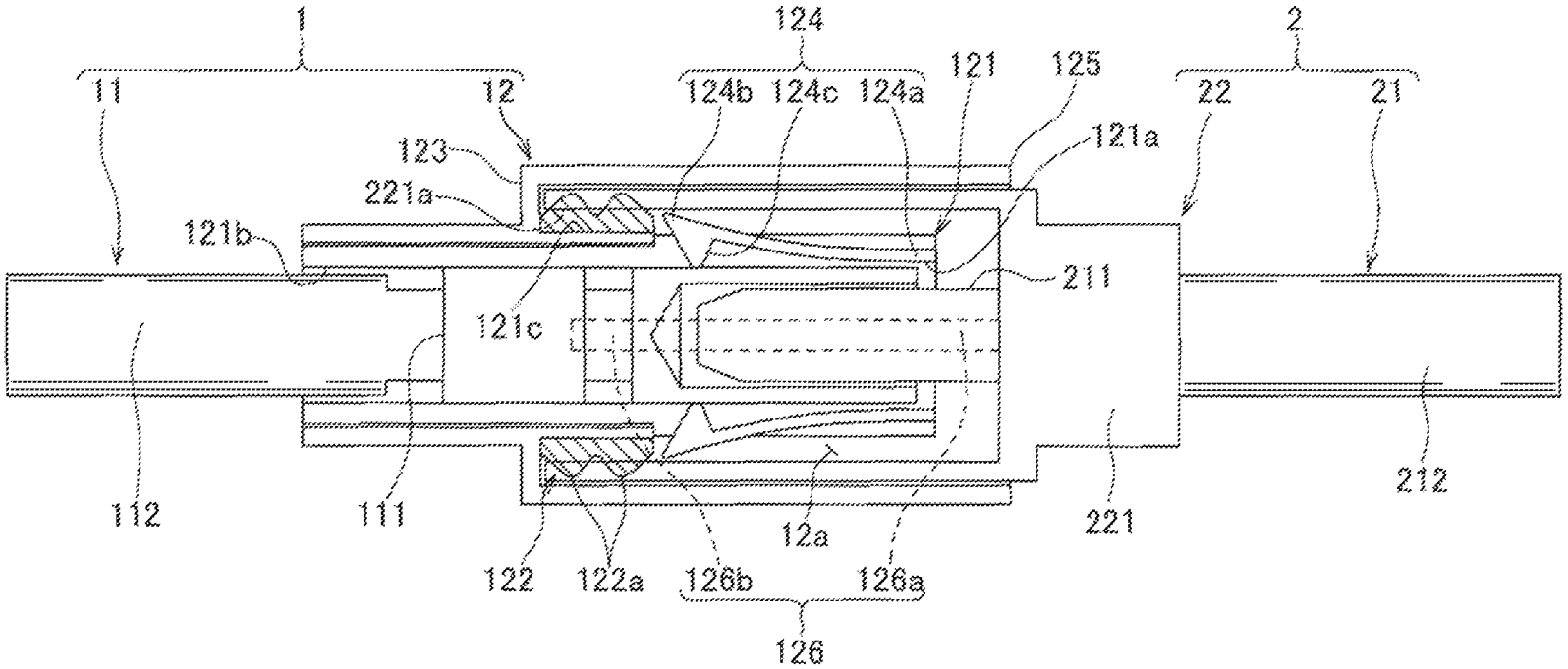
FIG. 2 is a cross sectional view taken along a line V11-V11 in FIG. 1, showing the wire harness of FIG. 1 and a connecting body for connection with the mating wire harness.
Figure 3:
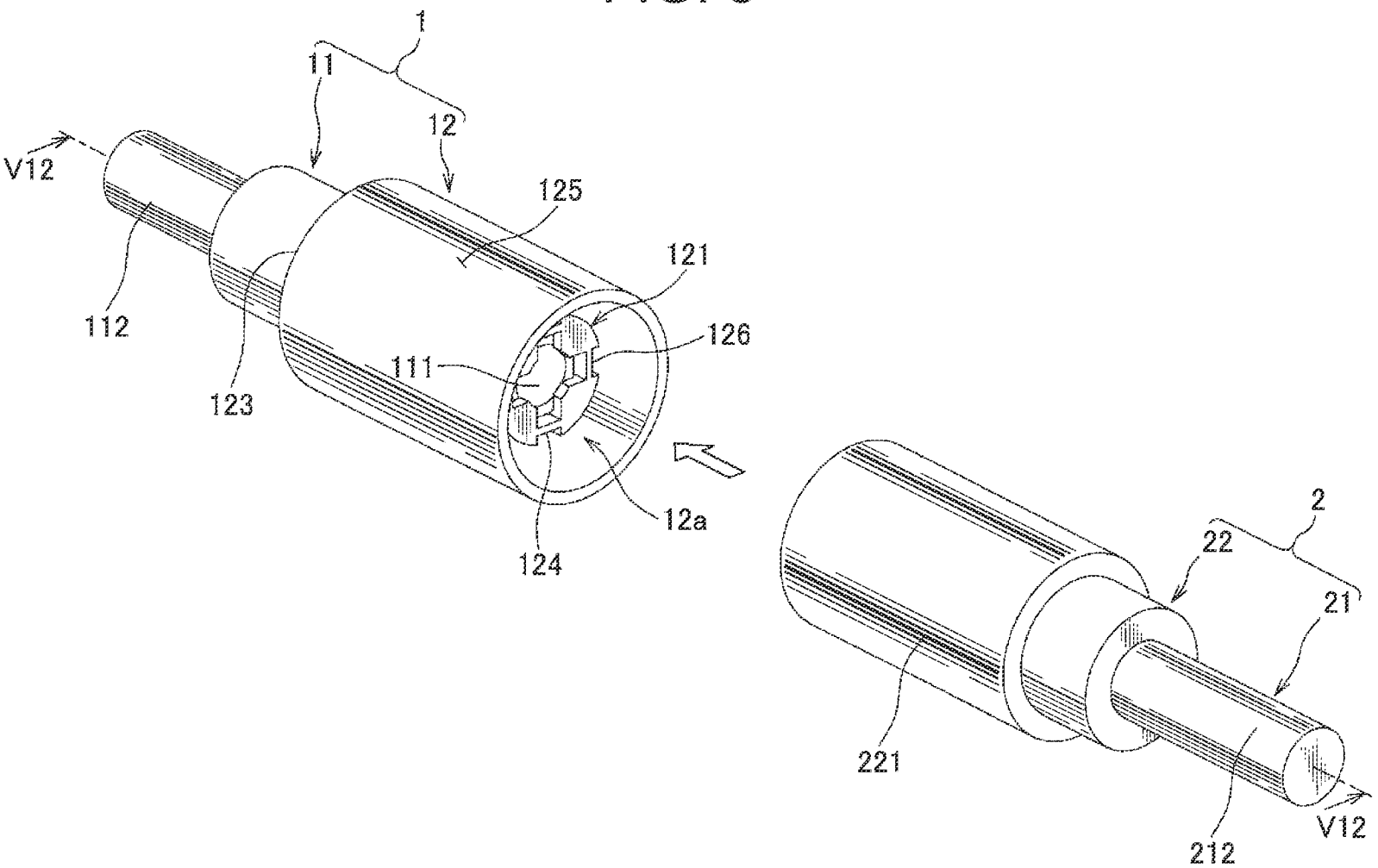
FIG. 3 is an exploded perspective view in which the mating wire harness is separated from the wire harness shown in FIG. 1.
Figure 4:
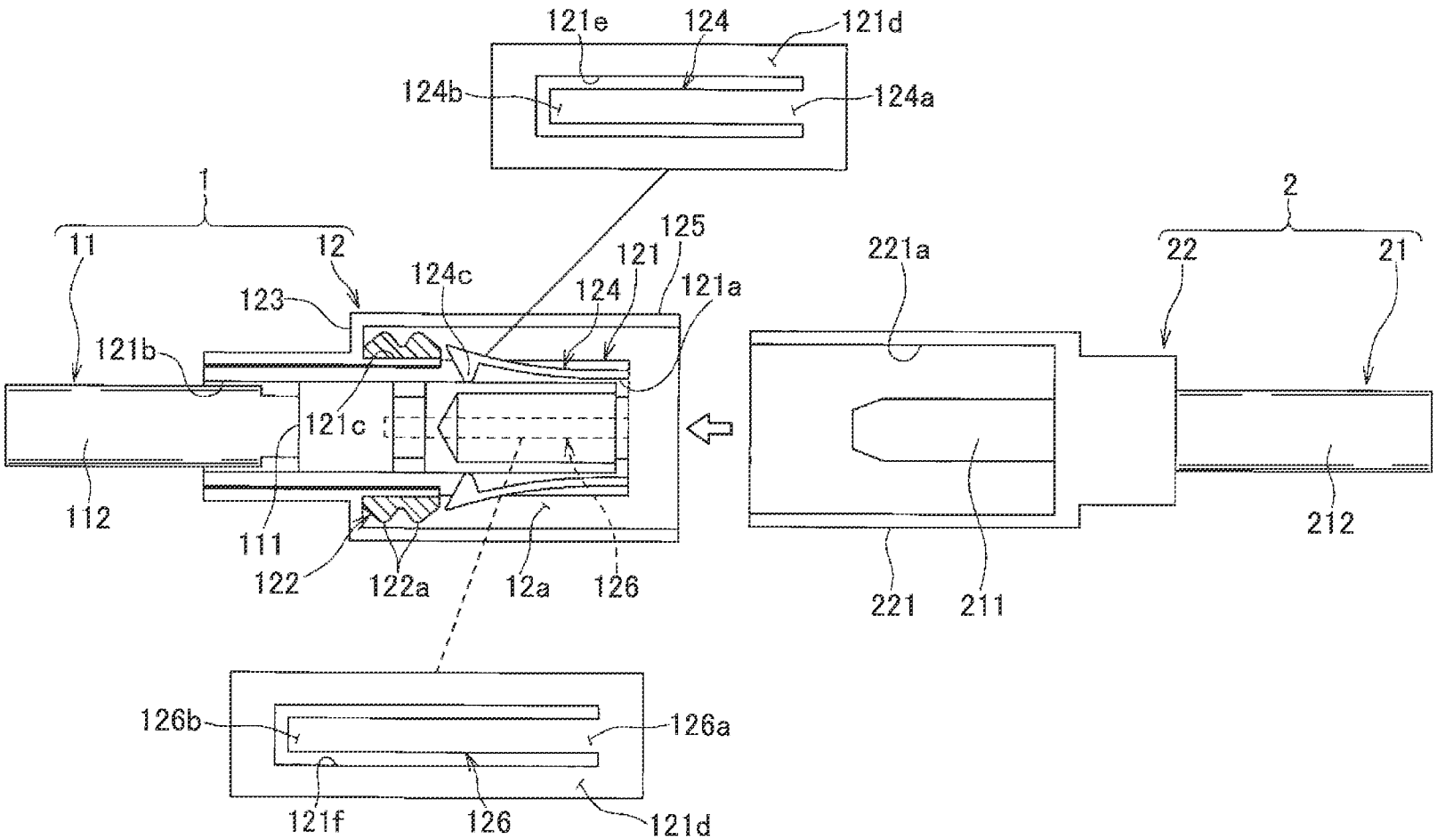
FIG. 4 is a cross-sectional view taken along a line V12-V12 in FIG. 3, showing the wire harness and the mating wire harness in a separated state shown in FIG. 3.

FIG. 1 is a perspective view of a wire harness having a connector housing according to one embodiment to which a mating wire harness is connected, and FIG. 2 is a cross sectional view taken along a line V11-V11 in FIG. 1, showing the wire harness of FIG. 1 and a connecting body for connection with the mating wire harness. FIG. 3 is an exploded perspective view in which the mating wire harness is separated from the wire harness shown in FIG. 1, and FIG. 4 is a cross-sectional view taken along a line V12-V12 in FIG. 3, showing the wire harness and the mating wire harness in a separated state shown in FIG. 3.

A wire harness 1 shown in FIG. 1 to FIG. 4 is configured to be wired, together with a mating wire harness 2, at places where liquid such as water could get on such as underfloor of a motor vehicle. The wire harness 1 and the mating wire harness 2 in this embodiment are both single-pole wire harnesses. The wire harness 1 includes one electric wire with terminal 11 and one connector housing 12, and similarly, the mating wire harness 2 includes one mating electric wire with terminal 21 and one mating connector housing 22.

First, the mating electric wire with terminal 21 includes a male type mating connector terminal 211 having a pin shape that is connected to an end of an electric wire portion 212 constituted of a covered electric wire. The mating connector housing 22 includes a mating housing body 221 made of rigid resin and formed in a circular tube shape that is provided with a locking portion and the like not shown. The mating wire harness 2 is constituted such that the mating connector terminal 211 of the mating electric wire with terminal 21 is accommodated in the tube-shaped mating housing body 221 and the electric wire portion 212 is extended to the outside.

Further, the electric wire with terminal 11 of the wire harness 1 of this embodiment includes a female type connector terminal 111 having a socket shape to which the mating connector terminal 211 described above can be fitted, and the connector terminal 111 is connected to an end of the electric wire portion 112 constituted of a covered electric wire. The connector housing 12 is a member made of rigid resin that accommodates the connector terminal 111 to constitute the wire harness 1. This connector housing 12 includes a housing body 121, a sealing member 122, a restriction wall portion 123, restriction flexible pieces 124, a hood wall portion 125 and terminal retaining flexible pieces 126.

The housing body 121 is formed in a tube shape and has an opening on one end side that is a connection side opening 121*a* arranged to enter inside the mating housing body 221 of the mating wire harness 2. The housing body 121 can accommodate the connector terminal 111 of the electric wire with terminal 11 from a rear opening 121*b* positioned on the side opposite to the connection side opening 121*a* such that the connector terminal 111 is connected to the mating connector terminal 211 at the connection side opening 121*a*. In this embodiment, this housing body 121 itself serves as a terminal accommodating chamber for accommodating one connector terminal 111.

The sealing member 122 is made of soft resin and formed in a ring shape, and is installed such that the housing body 121 is passed therethrough. A plurality of outer circumferential lips 122*a* is provided at an outer circumferential surface of the sealing member 122, the outer circumferential lips 122*a* being arranged to closely contact with an inner circumferential surface 221*a* of the mating housing body 221 when the connection side opening 121*a* of the housing body 121 has entered inside the mating housing body 221. This sealing member 122 is interposed between the outer circumferential surface 121*c* of the housing body 121 that has entered inside the mating housing body 221 and the inner circumferential surface 221*a* of the mating housing body 221 to provide a seal between them.

The restriction wall portion 123 is an annular wall that is provided at the outer circumferential surface 121*c* of the housing body 121 on the rear opening 121*b* side with respect to the position of the sealing member 122 and that is standing integrally with the housing body 121 over the entire circumference of the housing body 121 in the circumferential direction thereof. When the connection side opening 121*a* of the housing body 121 enters inside the mating housing body 221, this restriction wall portion 123 restricts the movement of the sealing member 122 that is pushed by an end of the mating housing body 221 and tries to move toward the rear opening 121*b*.

The restriction flexible piece 124 is a section surrounded by a U-shaped slit 121*e* formed by cutting a circumferential wall 121*d* of the housing body 121, as shown in FIG. 4 in a plan view with respect to the outer circumferential surface 121*c* of the housing body 121. This restriction flexible piece 124 is a flexible piece formed in a cantilever beam, one end thereof being a fixed end 124*a* that is integral with the circumferential wall 121*d* of the housing body 121, and another end thereof being a free end 124*b*. In this embodiment, the restriction flexible piece 124 is formed on the circumferential wall 121*d* of the housing body 121 such that the fixed end 124*a* is positioned on the side of the connection side opening 121*a* and the free end 124*b* is positioned on the side of the rear opening 121*b*. The restriction flexible pieces 124 are formed in a pair on the circumferential wall 121*d* of the housing body 121 so that, in the circumferential direction of the circumferential wall 121*d*, the pair of restriction flexible pieces 124 faces each other with a center axis therebetween. When the connector terminal 111 is accommodated from the rear opening 121*b*, each of the pair of restriction flexible pieces 124 is bent as will be described later, thereby regulating the movement of the sealing member 122 toward the connection side opening 121*a*.

The hood wall portion 125 is a circular tube-shaped wall that is formed integrally with the housing body 121 together with the restriction wall portion 123 and that is formed so as to extend to the side of the connection side opening 121*a* from a proximal edge of the restriction wall portion 123 which is standing in an annular fashion. The hood wall portion 125 defines an accommodating space 12*a* as described below between the hood wall portion 125 and the outer circumferential surface 121*c* of the housing body 121. The accommodating space 12*a* is a space in which the sealing member 122 is accommodated on the restriction wall portion 123 side and in which the circumferential wall of the mating housing body 221 is accommodated when the connection side opening 121*a* of the housing body 121 has entered inside the mating housing body 221. The outer circumferential surface of the hood wall portion 125 is provided with a locking portion not shown configured to engage with the locking portion of the mating connector housing 22.

The terminal retaining flexible piece 126 is substantially similar to the above-described restriction flexible piece 124 for regulating the movement of the sealing member 122 and is formed on the circumferential wall 121*d* of the housing body 121 at a position distant from the restriction flexible piece 124. As shown in plan view in FIG. 4, the terminal retaining flexible piece 126 is surrounded by a U-shaped slit 121*f* formed by cutting the circumferential wall 121*d* and is formed in a cantilever beam, one end thereof being a fixed end 126*a* that is integral with the circumferential wall 121*d* and another end thereof being a free end 126*b*. The terminal retaining flexible pieces 126 are formed in a pair on the circumferential wall 121*d* of the housing body 121 so that, in the circumferential direction of the circumferential wall 121*d*, the pair of terminal retaining flexible pieces is arranged to face each other with the center axis therebetween and is arranged at 90 degrees apart from the pair of restriction flexible pieces 124. When the connector terminal 111 is accommodated from the rear opening 121*b*, each of the pair of terminal retaining flexible pieces 126 bends in a manner as described below and engages with the connector terminal 111 to retain the connector terminal 111.

Figure 5:
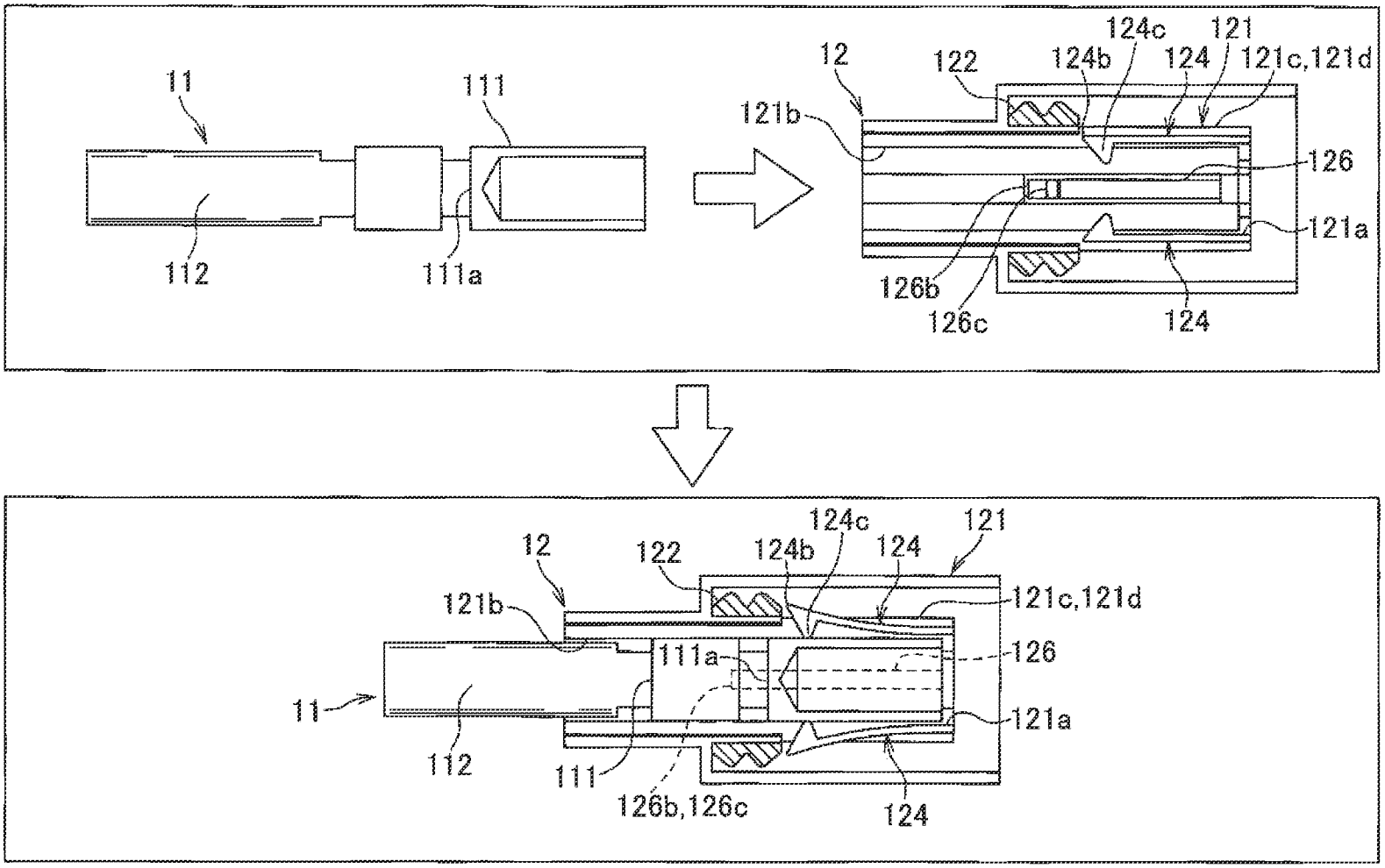
FIG. 5 shows the connector housing shown in FIG. 1 to FIG. 4, illustrating how restriction flexible pieces restrict the movement of a sealing member and how terminal retaining flexible pieces retain the connector terminal when the connector terminal is accommodated in a housing body.

FIG. 5 shows the connector housing shown in FIG. 1 to FIG. 4, illustrating how the restriction flexible pieces restrict the movement of the sealing member and how the terminal retaining flexible pieces retain the connector terminal when the connector terminal is accommodated in the housing body.

As shown in an upper part of FIG. 5, before the connector terminal 111 of the electric wire with terminal 11 is accommodated in the housing body 121 of the connector housing 12, the restriction flexible pieces 124 and the terminal retaining flexible pieces 126 are both not bent but extending straight. The free ends 124*b*, 126*b* of the restriction flexible pieces 124 and the terminal retaining flexible pieces 126 include projections 124*c*, 126*c* protruding toward an inner side of the circumferential wall 121*d* of the housing body 121.

As shown in a lower part of FIG. 5, when the connector terminal 111 is accommodated in the housing body 121, the projections 124*c* of the restriction flexible pieces 124 are pushed up by the connector terminal 111. As a result of this pushing up, the restriction flexible pieces 124 are bent so that the free ends 124*b* protrude from the outer circumferential surface 121*c* of the housing body 121, and the free ends 124*b* restrict the movement of the sealing member 122 toward the connection side opening 121*a*.

Further, when accommodating the connector terminal 111, the terminal retaining flexible pieces 126 are also bent together with the bending and deformation of the restriction flexible pieces 124. That is, the terminal retaining flexible pieces 126 are bent with the projections 126*c* pushed up by the connector terminal 111. In this embodiment, a narrowed portion 111*a* having a diameter smaller than that of the remaining portion is formed on the connector terminal 111 at a position close to a connection portion for connection with the electric wire portion 112. When the connector terminal 111 is accommodated, the terminal retaining flexible pieces 126 restore their position so that the projections 126*c* that had been pushed up as described above enter into the narrowed portion 111*a* once they have passed an edge of the narrowed portion 111*a*, and the projections 126*c* of the free ends 126*b* engage with the edge of the narrowed portion 111*a*. Due to this engagement on the free end 126*b* side, the terminal retaining flexible pieces 126 retain the connector terminal 111.

The connector housing 12 and the wire harness 1 of the embodiment described above provide the following advantageous effects. First, in this embodiment, the sealing member 122 is interposed between the outer circumferential surface 121*c* of the housing body 121 and the inner circumferential surface 221*a* of the mating housing body 221. This sealing member 122 seals a path through which the liquid ingresses inside the housing body 121 via the connection side opening 121*a* positioned on the side for connection with the mating connector housing 22. Further, the restriction wall portion 123 is standing on the rear opening 121*b* side with respect to the position of the sealing member 122, and, when the connector terminal 111 is accommodated, the free ends 124*b* of the restriction flexible pieces 124 protrude on the side of the connection side opening 121*a* with respect to the position of the sealing member 122. That is, when the connector terminal 111 is accommodated, the sealing member 122 is sandwiched between the restriction wall portion 123 and the free ends 124*b* of the restriction flexible pieces 124 and is retained so as not to fall off from the housing body 121. The restriction wall portion 123 and the restriction flexible pieces 124 are both integrally formed with the housing body 121, thus, this embodiment can reduce the number of components associated with the installation of the sealing member 122 and can thereby prevent complication in the structure.

In this embodiment, the restriction flexible pieces 124 are formed such that fixed ends 124*a* are positioned on the side of the connection side opening 121*a* and the free ends 124*b* are positioned on the side of the rear opening 121*b*. According to this configuration, the extending direction of the cantilever beam-shaped restriction flexible pieces 124 can be matched with the accommodating direction in which the connector terminal 111 is accommodated from the rear opening 121*b*, and as a result, the restriction flexible pieces 124 can be bent well when the connector terminal 111 is accommodated.

Further, in this embodiment, the restriction flexible pieces 124 are formed and arranged in a pair on the circumferential wall 121*d* of the housing body 121. According to this configuration, the respective free ends 124*b* of the pair of restriction flexible pieces 124 can more reliably restrict the movement of the sealing member 122 to the side of the connection side opening 121*a*.

Further, in this embodiment, there is provided the hood wall portion 125 extending from the proximal edge of the restriction wall portion 123 to the side of the connection side opening 121*a*. According to this configuration, the hood wall portion 125 blocks the arrival of the liquid from the outside to the liquid ingress path sealed by the sealing member 122, thereby preventing the ingress of the liquid more efficiently.

Further, in this embodiment, the terminal retaining flexible pieces 126 for retaining the connector terminal 111 is provided on the circumferential wall 121*d* of the housing body 121 and at the position distant from the restriction flexible pieces 124. According to this configuration, since the restriction flexible pieces 124 for the sealing member 122 and the terminal retaining flexible pieces 126 are formed in the cantilever beam shape similar to each other and thereby the structure is simplified, it is possible to reduce manufacturing cost. In addition, since the terminal retaining flexible pieces 126 are provided at the position distant from the restriction flexible pieces 124, the shapes of the respective flexible pieces can preferably be formed in shapes suitable for restricting the movement of the sealing member 122 and for retaining the connector terminal 111. In this embodiment, the restriction flexible pieces 124 and the terminal retaining flexible pieces 126 are formed to have different lengths, and the terminal retaining flexible pieces 126 that engage with the narrowed portion 111*a* of the connector terminal 111 are longer than the restriction flexible pieces 124.

The embodiment described above only illustrates representative forms of the connector housing and the wire harness, and the connector housing and the wire harness are not limited thereto and can be modified variously and implemented.

For example, in the embodiment described above, as one example of the wire harness, the wire harness 1 is exemplary shown which is wired at a place where liquid such as water could get on, such as the wire harness arranged underfloor of a motor vehicle. However, the wire harness is not limited thereto and may be a wire harness to be arranged in an interior of a motor vehicle, and its specific wiring form does not matter.

Further, in the embodiment described above, as one example of the connector housing and the wire harness, the connector housing 12 and the wire harness 1 of the single pole are exemplary shown. However, the number of poles of the connector housing and of the wire harness is not limited to one and may be two or more. In the case of multiple poles, inside of the tube-shaped housing body is partitioned into a plurality of terminal accommodating chambers. At this time, the restriction flexible piece may be provided corresponding to each terminal accommodating chamber, or may be provided corresponding to any one of the terminal accommodating chambers.

Further, in the above-described embodiment, as one example of the restriction flexible piece, the restriction flexible piece 124 is exemplary shown which is formed such that the fixed end 124*a* is positioned on the side of the connection side opening 121*a* and the free end 124*b* is positioned on the side of the rear opening 121*b*. However, the restriction flexible piece is not limited to this and may be the one that is formed so as to extend in the circumferential direction, for example. Thus, for the restriction flexible piece, a specific form thereof does not matter as long as it is a flexible piece formed in a cantilever beam shape having one end that is a fixed end and another end that is a free end. However, by forming so that the fixed end 124*a* is positioned on the side of the connection side opening 121*a* and the free end 124*b* is positioned on the side of the rear opening 121*b*, the restriction flexible piece 124 can be bent well when accommodating the connector terminal 111, as described above.

In the embodiment described above, as one example of the restriction flexible piece, the restriction flexible pieces 124 formed and arranged in one pair on the circumferential wall 121*d* of the housing body 121 are exemplary shown. However, the number the restriction flexible pieces formed is not limited to one pair, and only one restriction flexible piece may be formed, for example, or three or more restriction flexible pieces may be formed. However, by forming multiple restriction flexible pieces 124 (one pair, in the above-described embodiment), it is possible to more reliably restrict the movement of the sealing member 122, as described above.

Further, in the embodiment described above, as one example of the connector housing, the connector housing 12 having the hood wall portion 125 is exemplary shown. However, the connector housing is not limited to this and may not be provided with the hood wall portion. However, by providing the hood wall portion 125, it is possible to more effectively reduce the ingress of the liquid, as described above.

Further, in the embodiment described above, as one example of the connector housing, the connector housing 12 is exemplary shown in which it includes the terminal retaining flexible pieces 126 having the cantilever beam shape similar to the restriction flexible pieces 124 and being provided on the circumferential wall 121*d* of the housing body 121 separately from the restriction flexible pieces 124. However, the connector housing is not limited to this, and it may be configured such that the restriction flexible pieces serve as the terminal retaining flexible pieces, or it may be provided with a separate terminal retaining structure which is different from the cantilever beam-shaped structure. However, by separately providing the terminal retaining flexible pieces 126 having the cantilever beam shape similar to the restriction flexible pieces 124, manufacturing cost can be reduced, and respective shapes thereof can preferably be formed in shapes suitable in application, as described above.

LIST OF REFERENCE SIGNS

1 wire harness
2 mating wire harness
11 electric wire with terminal
12 connector housing
12*a* accommodating space
21 mating electric wire with terminal
22 mating connector housing
111 connector terminal
111*a* narrowed portion
112 electric wire portion
121 housing body
121*a* connection side opening
121*b* rear opening

121*c* outer circumferential surface
121*d* circumferential wall
121*e*, 121*f* slit
122 sealing member
122*a* outer circumferential lip
123 restriction wall portion
124 restriction flexible piece
124*a*, 126*a* fixed end
124*b*, 126*b* free end
124*c*, 126*c* projection
125 hood wall portion
126 terminal retaining flexible piece
211 mating connector terminal
221 mating housing body
221*a* inner circumferential surface

What is claimed is:

1. A connector housing comprising:

a housing body formed in a tube shape having a connection side opening formed on one end side of the housing body and a rear opening positioned on a side opposite to the connection side opening, the connection side opening of the housing body being configured to enter inside a tube-shaped mating housing body of a mating wire harness, the mating wire harness including the mating housing body accommodating therein a mating connector terminal of a mating electric wire with terminal, the housing body being capable of accommodating a connector terminal of an electric wire with terminal from the rear opening such that the connector terminal is connected to the mating connector terminal at the connection side opening;

a sealing member made of resin and formed in a ring shape, the sealing member being configured to pass the housing body therethrough, the sealing member being configured such that, when the connection side opening of the housing body enters inside the mating housing body, the sealing member is interposed between an outer circumferential surface of the housing body and an inner circumferential surface of the mating housing body to seal a space between the outer circumferential surface and the inner circumferential surface;

a restriction wall portion standing on the outer circumferential surface of the housing body and positioned on a side of the rear opening with respect to a position of the sealing member, the restriction wall portion being provided over an entire circumference in a circumferential direction of the housing body, the restriction wall portion being configured to restrict movement of the sealing member to the side of the rear opening; and a restriction flexible piece formed on a circumferential wall of the housing body and positioned on a side of the connection side opening with respect to the position of the sealing member, the restriction flexible piece being surrounded by a U-shaped slit formed by cutting the circumferential wall such that the restriction flexible piece is formed in a cantilever beam shape having one end that is a fixed end and another end that is a free end, the free end including a projection protruding toward an inner side of the circumferential wall, the restriction flexible piece being configured such that, when the connector terminal is accommodated from the rear opening, the restriction flexible piece is bent such that the projection is pushed up by the connector terminal so the free end protrudes from the outer circumferential surface, and the free end thereby restricts movement of the sealing member toward the side of the connection side opening.

2. The connector housing according to claim 1, wherein the restriction flexible piece is a portion which is formed on the circumferential wall of the housing body such that the fixed end is positioned on the side of the connection side opening and the free end is positioned on the side of the rear opening.

3. The connector housing according to claim 1, wherein a plurality of the restriction flexible pieces is formed on the circumferential wall of the housing body so as to be disposed in the circumferential direction.

4. The connector housing according to claim 1, further comprising a hood wall portion that is a tube-shaped wall formed so as to extend from a proximal edge of the restriction wall portion to the side of the connection side opening, wherein the hood wall portion defines an accommodating space in which the sealing member is accommodated between the hood wall portion and the outer circumferential surface of the housing body and in which a circumferential wall of the mating housing body is accommodated when the connection side opening of the housing body enters inside the mating housing body.

5. The connector housing according to claim 1, further comprising a terminal retaining flexible piece that is formed on the circumferential wall of the housing body at a position distant from the restriction flexible piece and that is surrounded by a U-shaped slit formed by cutting the circumferential wall such that the terminal retaining flexible piece is formed in a cantilever beam shape having one end that is a fixed end and another end that is a free end, wherein when the connector terminal is accommodated from the rear opening, the terminal retaining flexible piece engages with the connector terminal at a side of the free end to retain the connector terminal.

6. A wire harness comprising:

an electric wire with terminal; and the connector housing according to claim 1 that is configured to accommodate a connector terminal of the electric wire with terminal.

* * * * *